United States Patent [19]

Ollman

[11] 4,030,256

[45] June 21, 1977

[54] BUILDING CONSTRUCTION

[76] Inventor: Melvin L. Ollman, 16730 Huntington, Detroit, Mich. 48219

[22] Filed: Nov. 20, 1975

[21] Appl. No.: 633,644

[52] U.S. Cl. ..... 52/90; 52/634; 52/643; 52/694

[51] Int. Cl.[2] ..... E04B 7/00; E04C 3/02

[58] Field of Search ..... 52/634, 643, 635, 693, 52/694, 760, 351, 753 L, 753 P, 90; 14/13

[56] References Cited

UNITED STATES PATENTS

| | | | |
|---|---|---|---|
| 1,880,478 | 10/1932 | Ragsdale | 52/694 |
| 1,911,018 | 5/1933 | Goeltz | 52/694 |
| 2,201,504 | 5/1940 | Ruppel | 52/643 |
| 2,234,960 | 3/1941 | Buelow | 52/760 |
| 2,365,175 | 12/1944 | Crawford | 52/643 |
| 2,376,023 | 5/1945 | Bailey | 14/13 |
| 3,849,961 | 11/1974 | Gwynne | 52/760 |
| 3,882,653 | 5/1975 | Ollman | 52/694 |

FOREIGN PATENTS OR APPLICATIONS

| | | | |
|---|---|---|---|
| 542,229 | 12/1941 | United Kingdom | 52/90 |
| 398,181 | 9/1933 | United Kingdom | 52/351 |

*Primary Examiner*—Price C. Faw, Jr.
*Assistant Examiner*—James L. Ridgill, Jr.
*Attorney, Agent, or Firm*—Barnes, Kisselle, Raisch & Choate

[57] ABSTRACT

A building construction comprising a foundation, a plurality of vertically extending truss members and a plurality of roof frames. Each truss member comprises spaced channels with alternately extending struts connected between the channels. Each roof frame is associated with opposed pairs of the upright truss members and includes vertical legs comprising truss members aligned with the upright truss members and horizontal truss members of substantially identical construction extending between the upright legs.

11 Claims, 16 Drawing Figures

35
81
80
80
39
28
31
81
38
21
37
36
39
50
52
20
23
24
52
22
66
67
68
5
5
5
67a
67b
68a
68b
69a
69b
11
11

BUILDING CONSTRUCTION

This invention relates to building construction.

BACKGROUND OF THE INVENTION

Among the objects of the invention are to provide a building construction wherein a steel building can be made of prefabricated units that can be readily handled and transmitted to the job site, erected with minimal skill and labor and which will provide adequate strength to the building.

SUMMARY OF THE INVENTION

In accordance with the invention, the building construction comprises a foundation, a plurlaity of vertically extending truss members and a plurality of roof frames. Each truss member comprises spaced channels with alternately extending struts connected between the channels. Each roof frame is associated with opposed pairs of the upright truss members and includes vertical legs comprising similar truss members aligned with the upright truss members and horizontal truss members of substantially identical construction extending between the upright legs.

DESCRIPTION

Figure 1:
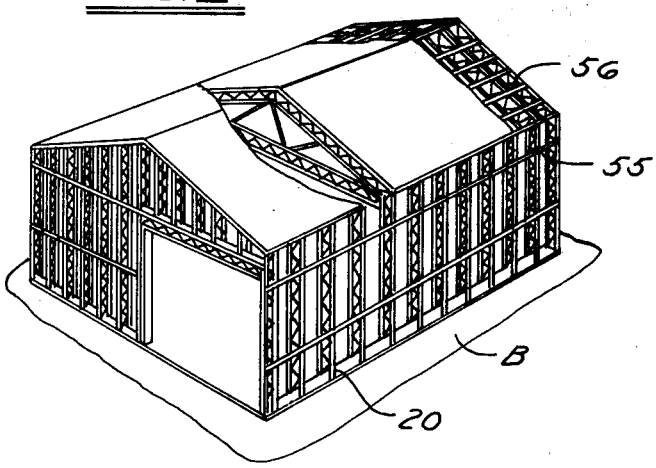
FIG. 1 is a part sectional perspective view of a building embodying the invention.

Referring to FIG. 1, the building embodying the invention is placed on a foundation or base B and includes a plurality of prefabricated upright truss members 20 and of roof frames 21 each of which assembled from truss members.

Figure 2:
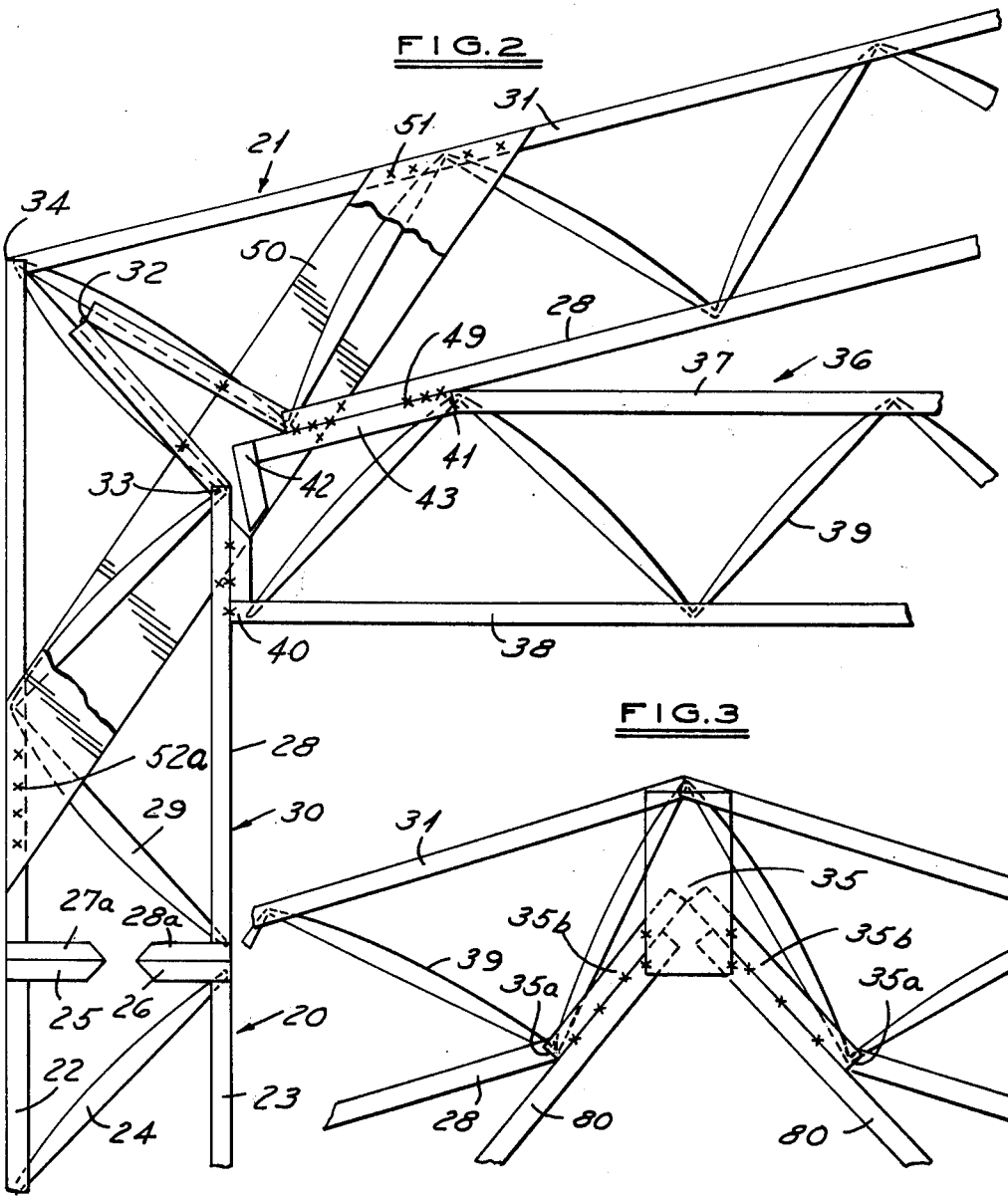
FIG. 2 is a fragmentary elevational view of a portion of the building shown in FIG. 1.
Figure 3:
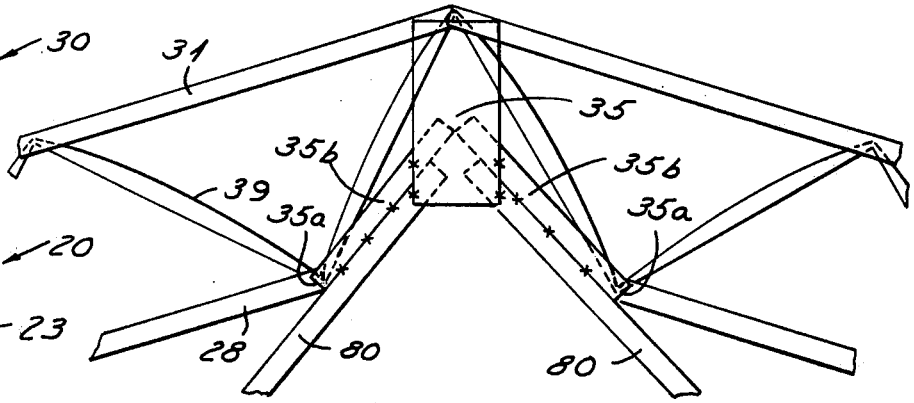
FIG. 3 is a fragmentary elevational view of another portion of the building shown in FIG. 1.
Figures 9, 10, 11:
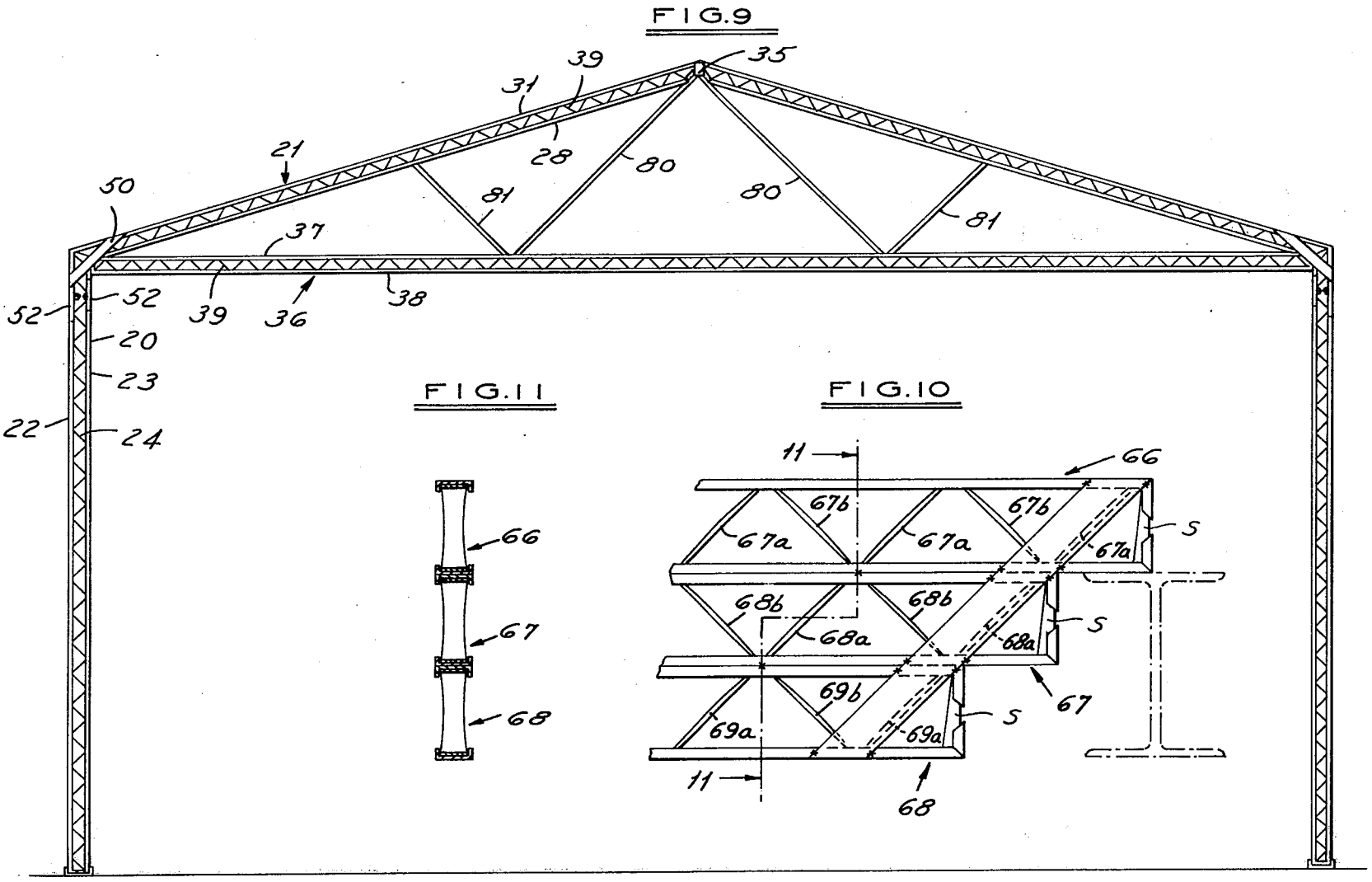
FIG. 9 is a elevational view of a portion of the building shown in FIG. 1.
FIG. 10 is a fragmentary elevational view of a modified form of building construction.
FIG. 11 is a fragmentary sectional view taken along the line 11—11 in FIG. 10.

Referring to FIG. 9, each upright truss member comprises opposed channels 22, 23 with alternately extending strut members 24 welded at the apices to the channels 22, 23. Each channel 22, 23 includes a base and inwardly extending flanges. The flanges of the upper portions of the channels 22, 23 are cut to permit the free ends 25, 26 to be bent inwardly. (FIG. 2)

The roof truss of frame 21 is also made of similar trusses including channels 27, 28 with alternately extending struts 29. The roof truss frame includes one truss member that has legs 30 at each end, each leg 30 having inwardly extending channel portions **27*a*, 28*a* that abut the portions 25, 26 of the upright 20 and an angled portion 31 that is formed by cutting the channels 27, 28**.

More specifically, channel 28 is cut through at its center as at 32 and has its flanges cut at the adjacent apex of the struts as at 33 and bent upwardly at that point.

To form the gable, flanges of channel 27 are cut and the base of channel 27 is bent at that point and the channel 28 is cut through at a point opposite as at 35 and the flanges of channel 28 are cut at the adjacent apex as at **35*a* to define a portion 35*b* which is bent upwardly. The flanges of channel 27 are cut as at 34** and the base thereof is bent at that point.

Reinforcing members 80 are welded to the projection portions **35*b* extended at an angle and are welded to truss 36. Additional reinforcing members 81 are welded to struts and extend upwardly and outwardly from truss 36 to the upper truss (FIG. 9). Reinforcing members 80, 81** may be tubular or U-shaped in cross section.

The roof frame 21 further includes a horizontal truss 36 including upper and lower channels 37, 38 and an undulating or alternately extending struts 39. The free end of the flanges of the lower channel 38 are cut as at 40 and bet upwardly and welded to the channel 28 while the free end of the upper channel 37 is cut at 41 and 42 and bent so that the intermediate portion 43 abuts the channel 28 and is welded thereto as at 49. Finally reinforcing plates 50 are provided across the portions 30, 31 and are welded thereto as at **51, 52*a***.

Figure 4:
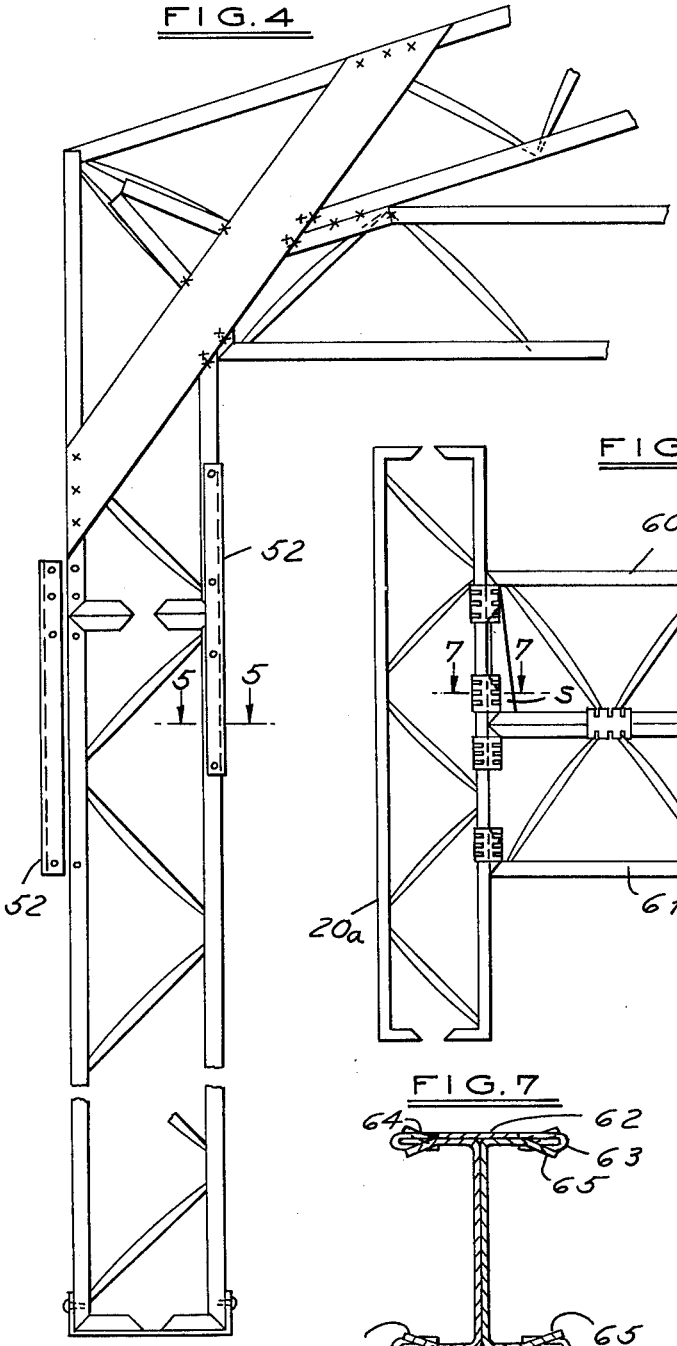
FIG. 4 is a fragmentary elevational view showing the parts in paritally assembled position.
Figure 5:
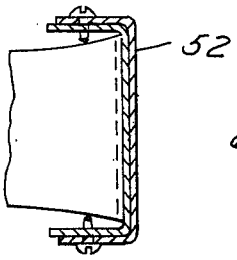
FIG. 5 is a sectional view on a enlarged scale taken along the line 5—5 in FIG. 4.
Figure 8A:
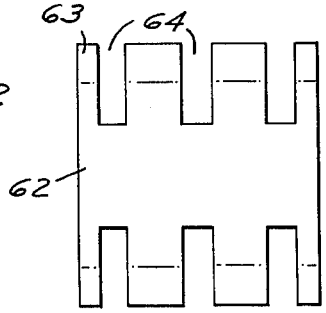
FIG. 8A is a plan view of a joining clip utilized in the construction shown in FIGS. 6–8.

The upright 20 is connected to the leg 28 at the job site by assembly channels 52 that are fastened by sheet metal screws (FIGS. 4, 5).

Each of the subassemblies of the uprights 20 and roof frames 21 are erected in position and held by girts 5 and purlins 56. The building can then be completed by providing siding and roofing. Additional truss members 57 are provided at the ends of the buildings as required.

Figure 6:
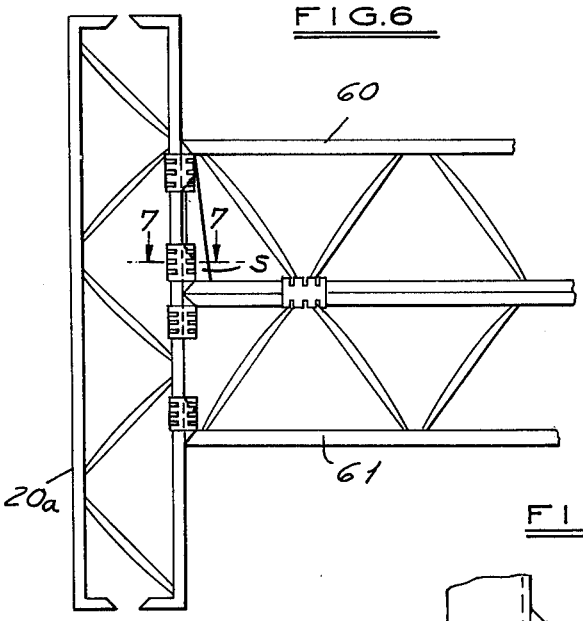
FIG. 6 is a fragmentary elevational view of a modified form of the building.
Figure 8:
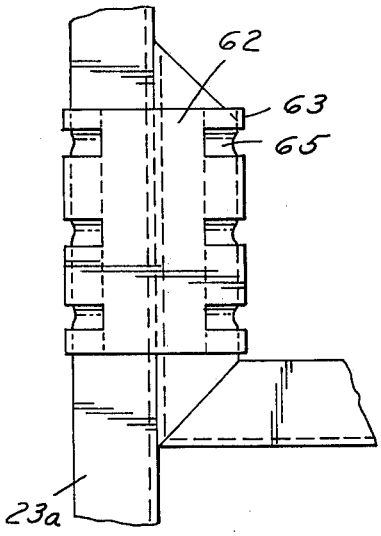
FIG. 8 is a fragmentary elevational view on an enlarged scale of a portion of the building shown in FIG. 6.
Figure 7:
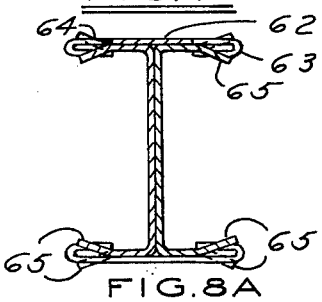
FIG. 7 is a fragmentary sectional view taken along the line 7—7 in FIG. 6.

In the form of the invention shown in FIG. 6, the upright **20*a* has horizontal trusses 60, 61 fastened thereto. The trusses 60, 61 are in turn connected to one another. The connection between the upright 20*a* and the trusses 60, 61 may be by welding or by means of joining clips 62 each of which has laterally extending fingers 63 defining spaces 64. The clips are placed into position on the abutting channels 23*a*, 62 and the tabs 63 are bent about the flanges of the channel. In addition a tool is utilized to deform the portions 65 of the flanges 62 between the tabs 63 in the spaces 64 out of the plane of the flanges 62 to lock the flanges and in turn the truss members together. Portions 65 may be deformed out of the plane in the same direction or alternately in opposite directions. Instead of utilizing clips 62, welding can be utilized as in the form of the invention shown in FIGS. 1–5**.

In the form of the invention shown in FIGS. 10 and 11, a beam construction is provided wherein truss members 66, 67, 68 of different lengths are welded to one another and gusset plates are provided at the ends. The ends are interrelated such that struts 67*a*, 68*a*, 69*a* are aligned and struts 67*b*, 68*b*, 69*b*, are aligned. In addition reinforcing struts S are provided as in U.S. Patent No. 3,882,653.

Figure 12:
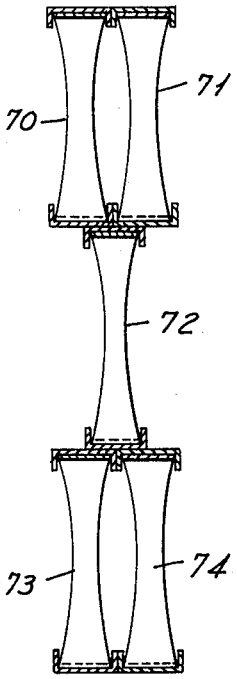
FIG. 12 is a fragmentary sectional view of a modified form of building construction.
Figure 13:
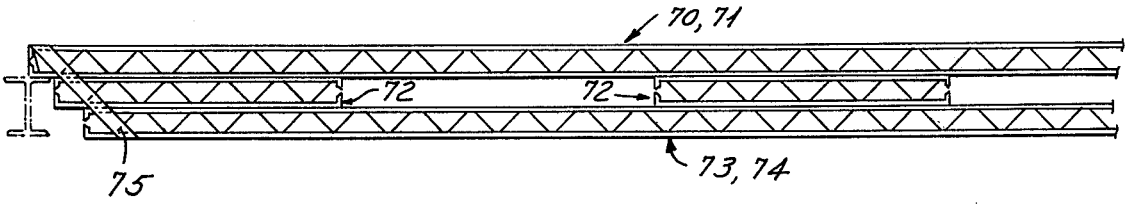
FIG. 13 is an elevational view of the beam shown in FIG. 12.

In a modified form of the invention shown in FIGS. 12 and 13, the horizontal beam or truss is formed by substantially identical truss members 70, 71 welded to one another and provided centrally over a truss 72 which in turn is provided over trusses 73, 74. The trusses are welded to one another or otherwise fastened to one another. As shown in FIG. 13, the trusses 72 may not necessarily extend the entire length of the trusses 70, 71 and 73, 74 but may be spaced along portions thereof. A gusset plate 75 is welded at the ends at an angle as shown in FIG. 15.

Figure 14:
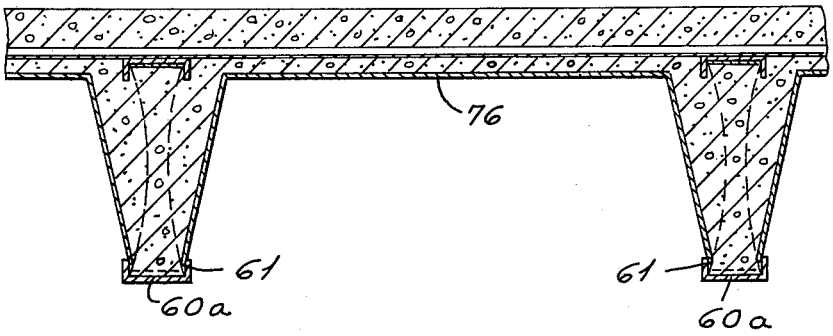
FIG. 14 is a fragmentary longitudinal sectional view of a modified form of building.
Figure 15:
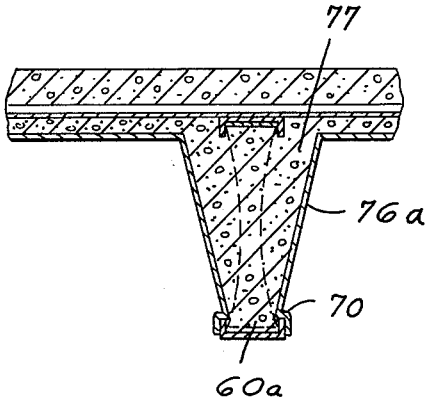
FIG. 15 is a view similiar to FIG. 14 of a further modified form of building.

In the form shown in FIGS. 14 and 15, adjacent portions of the horizontal trusses 60*a* have imperforate housings 76 extending therebetween so that cementitious material such as concrete 77 can be poured into the spaces to cover the trusses and form the deck on the trusses. The edges of sheet metal strip can fit inside of the flanges 61 so that the strip is retained in position or may be formed with a step as at 77 as shown in FIG. 15. In the latter instance, strip 76*a* can be removed after the cementitious material is set.

Each of the constructions shown utilizes truss members such as shown in U.S. Pat. No. 3,882,653 wherein the struts taper uniformly from line contact with the channels to a U-shaped cross section.

I claim:

1. In a building construction, the combination comprising a foundation, a plurality of vertically extending truss members, each said truss member comprising spaced channels with alternately struts connected between said channels, a roof frame associated with each opposed pair of said vertically extending truss members, each roof frame comprising truss members including spaced outer and inner channels with alternately extending struts connected between said channels, said roof frame having an upright portion at each end thereof defining a leg having the spaced outer and inner channels thereof extending vertically and alternately extending struts connected between said channels, said channels of said leg being aligned with a vertically extending truss member, and means joining each said leg of said upright roof frame and its respective vertically extending truss member, said roof frame having an inclined portion extending upwardly and inwardly from each said leg of said roof frame, said leg of said roof frame having a strut extending the outer channel thereof at the juncture of the outer channel of said leg of said roof frame with said outer channel of said inclined portion, and said inclined portion including a strut extending to said area of juncture of said outer channel of said inclined roof portion and the outer channel of said leg of said roof frame, and a gusset plate fastened to a juncture of a pair of said strut members and said outer channel of said leg and fastened to the juncture of a pair of said strut members and said outer channel of said inclined portion.

2. The combination set forth in claim 1 wherein the lower end of a channel of said leg of said frame has a strut extending thereto and the upper end of the associated channel of the vertically extending member has a strut extending thereto.

3. The combination set forth in claim 1 wherein said outer channel of said leg of said roof frame and said outer channel of the inclined roof portion of the roof frame are integral.

4. The combination set forth in claim 1 including an additional truss member comprising upper and lower channel members and alternately extending struts connected between said channels, said upper channel said last-mentioned truss member having an end portion extending along and joined to the lower channel of said inclined portion of said roof frame.

5. The combination set forth in claim 1 wherein said means joining said leg of said roof frame and its respective vertically extending truss member comprises U-shaped brackets extending over said outer and inner channels, respectively, of said leg of said roof frame and said vertically extending truss member, and means joining said brackets to said channels.

6. The combination set forth in claim 1 wherein said roof frame comprises a gable formed by said inclined portions, said inclined portions having struts thereof meeting at a point at said gable, and a gusset plate overlying and joined to said inclined portions.

7. In a building construction, the combination comprising a roof frame, said roof frame comprising truss members including spaced outer and inner channels with alternately extending struts connected between said channels, said roof frame having an upright portion at each end thereof defining a leg having the spaced outer and inner channels thereof extending vertically, said roof frame having an inclined portion extending upwardly and inwardly from each said leg of said roof frame, said leg of said upright roof truss member having a strut extending to the outer channel thereof at the juncture of the outer channel of said leg of said roof frame with said outer channel of said inclined portion, and said inclined portion including a strut extending to said area of juncture of said outer channel of said inclined portion and the outer channel of said leg of said roof frame, and a gusset plate fastened to a juncture of a pair of said strut members and said outer channel of said leg and fastened to the juncture of a pair of said strut members and said outer channel of said inclined portion.

8. The combination set forth in claim 7 wherein the lower end of a channel of said leg of said frame has a strut extending thereto and the upper end of the associated channel of the vertically extending member has a strut extending thereto.

9. The combination set forth in claim 7 wherein said outer channel of said leg of said roof frame and said outer channel of said inclined roof portion are integral.

10. The combination set forth in claim 7 including an additional truss member comprising upper and lower channel members and alternately extending struts connected between said channels, said upper channel of said last-mentioned truss member having an end portion extending along and joined to the lower channel of said inclined portion of said roof frame.

11. The combination set forth in claim 7 wherein said roof frame comprises a gable formed by said inclined portions, said inclined portions having struts thereof meeting at a point at said gable, and a gusset plate overlying and joined to said inclined portions.

* * * * *